United States Patent [19]

Johannson

[11] 4,442,922

[45] Apr. 17, 1984

[54] ADJUSTABLE SLIDER BEARING ASSEMBLY

[75] Inventor: Richard J. Johannson, Dallas, Oreg.

[73] Assignee: Towmotor Corporation, Mentor, Ohio

[21] Appl. No.: 277,749

[22] PCT Filed: Mar. 16, 1981

[86] PCT No.: PCT/US81/00330

§ 371 Date: Mar. 16, 1981

§ 102(e) Date: Mar. 16, 1981

[87] PCT Pub. No.: WO82/03215

PCT Pub. Date: Sep. 30, 1982

[51] Int. Cl.[3] ..... B66B 9/20

[52] U.S. Cl. ..... 187/9 E; 187/95; 308/3 B; 182/62.5; 212/269; 52/117

[58] Field of Search ..... 187/9 R, 9 E, 95, 2, 187/6, 3, 19; 308/3 R, 3 B, 6 R, 3 C; 104/95, 89; 182/36, 38, 63, 141, 62.5; 212/230, 231, 266, 267, 269, 184; 414/718; 52/118, 111, 117, 632

[56] References Cited

U.S. PATENT DOCUMENTS

| | | | |
|---|---|---|---|
| 1,003,566 | 9/1911 | Winters | 187/95 |
| 1,566,490 | 12/1925 | Lindquist | 308/3 B |
| 1,702,783 | 2/1929 | Kiesling | 187/95 |
| 2,647,675 | 8/1953 | Bennett | 187/6 |
| 2,888,300 | 5/1959 | Curtis et al. | 308/3 |
| 3,213,967 | 10/1965 | Hastings, Jr. et al. | 187/9 |
| 3,313,376 | 4/1967 | Holland, Sr. | 187/95 |
| 3,329,240 | 7/1967 | Harwood et al. | 187/95 |
| 3,385,401 | 5/1968 | Campbell et al. | 187/11 |
| 3,537,762 | 11/1970 | Lodige | 308/3 R |
| 3,620,579 | 11/1971 | Brown | 308/3 R |
| 3,669,280 | 6/1972 | Garrett et al. | 308/3 R |
| 4,056,170 | 11/1977 | Chelin | 187/95 |
| 4,154,447 | 5/1979 | Francis, Jr. et al. | 277/24 |
| 4,234,057 | 11/1980 | Nakane et al. | 187/9 |
| 4,271,932 | 6/1981 | Klein | 308/3 B |

FOREIGN PATENT DOCUMENTS

| | | | |
|---|---|---|---|
| 2306677 | 8/1974 | Fed. Rep. of Germany | 308/3 R |

*Primary Examiner*—Kenneth W. Noland

*Attorney, Agent, or Firm*—Alan J. Hickman

[57] ABSTRACT

The invention provides several embodiments of support assemblies (26,30,32) suitable for use in a lift mast (10). Each support assembly (26,30,32) has two slider bearings (36) for symetrically loading the main loading surface (37) and the inboard and outboard flange edge (38,40) of the corresponding I-beams (19) used in an upright assembly (16) incorporated in the lift mast (10). The support assemblies (26,30,32) include positioning screws (68) for adjusting the slider bearings (36) against the flange edges (38,40). The need for shims is thereby avoided. These positioning screws (68) permit the slider bearings (36) to pivot so as to ensure they remain in full face contact with the corresponding flange edge (38,40). The slider bearings (36) each accept two, mutually perpendicular loadings simplifying the construction of these support assemblies (26,30,32).

9 Claims, 8 Drawing Figures

26
IV
74
46
79
44
78
22
21
14
66
38
48
59
36
62
51
24
50
37
56
19
62
48
59
58
14
66
40
44
46
34
76
IV
68
14
74

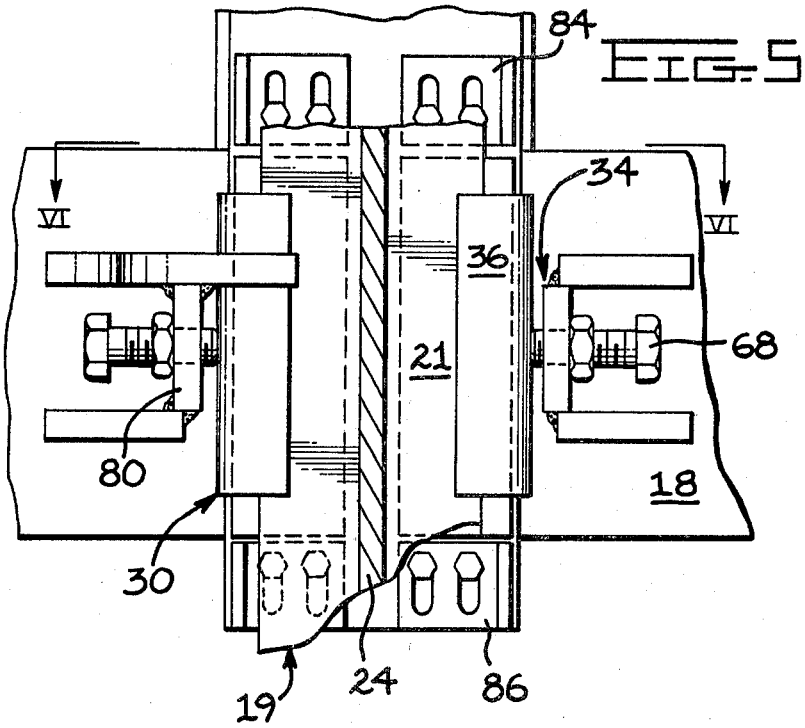
FIG. 6
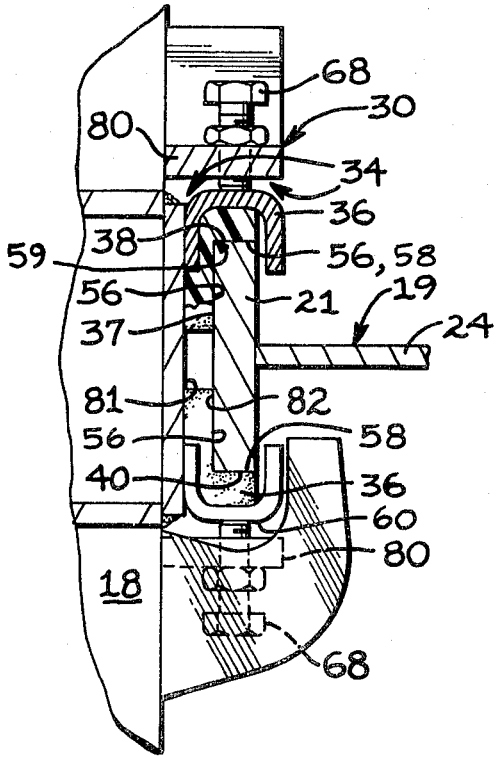

ADJUSTABLE SLIDER BEARING ASSEMBLY

DESCRIPTION

1. Technical Field

This invention relates generally to slider bearings and more particularly to adjustable slider bearings for a mast of a lift truck.

2. Background Art

Many of the most significant problems faced by designers of lift trucks have centered around the development of an improved lift mast. There is significant competition in the industry to provide a less expensive mast of decreased mast weight to load ratio which is sufficiently rigid to resist deformation yet which does not unduly restrict visibility.

Typically, lift truck masts include a support frame borne by the lift truck, at least one pair of uprights vertically extensible within this support frame, and a load supporting carriage movable along these uprights. Such a lift mast is disclosed by Hastings et al in U.S. Pat. No. 3,213,967 issued Oct. 26, 1965. This and other known mast designs for lift trucks include at least one set of connecting members joining the carriage to the uprights and another set for joining the uprights to the support frame. Typically these connecting members are fashioned and positioned such that they impose an unbalanced sideways torque about the longitudinal axis of each of the uprights (that is, torque about the vertical axis of each upright tending to twist each upright in a sideways manner toward or away from the other of the uprights). The unbalanced stresses caused by these torques can result in deformation of the uprights which often causes uneven wear and undue friction of the components in the mast assembly.

The connecting members include bearings to provide substantially unimpeded moving contact between the elements joined by the connecting members. In most lift mast designs these bearings are roller bearings. As compared to slider bearings, the use of roller bearings introduces several problems: they are high in cost; they require relatively smooth finishing of the surfaces on which they act; they make more difficult the assembly and disassembly of the mast; they may require lubrication; and, they create significant amounts of noise in their operation.

For all of their advantages, slider bearings have not come into significant commercial use for lift truck masts. This has been due in part to the lack of an adequate device for positioning the slider bearing between the members it joins. During use the slider bearings wear. This causes gaps to develop between the bearings and the members between which the bearings are interposed. This excessive tolerance, known in the art as "slop," between adjoining members causes a loss of mast ridigity, a decrease in controllability, increased impact loadings, uneven and accelerated slider bearing wear, and is otherwise disadvantageous as is known to those skilled in the art.

The more advanced slider bearing assemblies for lift mast assemblies incorporate shims for accommodating slider bearing wear. When the bearing wear reaches the point where an unacceptable gap exists, a shim may be inserted thereby improving the tolerances between the relevant members. Eventually the wear becomes sufficiently great that the bearing must be replaced. Such a system is disclosed in U.S. Pat. No. 3,999,675 issued to Forry et al on Dec. 28, 1976. Inserting this shim is an awkward and time-consuming maintenance measure which it would be highly advantageous to avoid.

A related disadvantage of existing lift truck mast slider bearing assemblies is that they are supported by one planar surface and are slidingly contacted by an opposing planar surface. If these two surfaces are not perfectly parallel the slider bearing, which is also planar, will be unevenly loaded. As a result the sliding friction is increased and the slider bearing is unevenly worn.

A further disadvantage of known lift masts incorporating slider bearings is that no known connecting member design serves to substantially eliminate side to side tilting of the carriage attendant side thrust loading. It would be beneficial if an arrangement of simple slider bearing type connecting member assemblies avoided this problem.

The present invention is directed to overcoming one or more of the problems as set forth above.

DISCLOSURE OF THE INVENTION

In one aspect of the present invention a connecting assembly movably connects a first member having a sliding surface to a second member. A fulcrum is connected to one of the first and second members and a bearing is interposed between the fulcrum and the other of the first and second members.

This invention provides an adjustable slider bearing which is pivotable so as to remain in substantially full face contact with a member which is slidable across it. Additionally, each of the slider bearings of the present invention can accept orthogonally oriented loads. The connecting assembly of the present invention incorporating these slider bearings serves to symmetrically load an I-beam with which it is associated, preventing the torque loadings common to existing connecting assemblies.

BRIEF DESCRIPTION OF THE DRAWINGS

FIG. 5 is a diagrammatic sectional view of the lower carriage-upright support assembly viewed from the vehicle toward the carriage;

FIG. 6 is a diagrammatic sectional view taken along line VI—VI of FIG. 5 further detailing the lower carriage-upright support assembly;

BEST MODE FOR CARRYING OUT THE INVENTION

Figure 1:
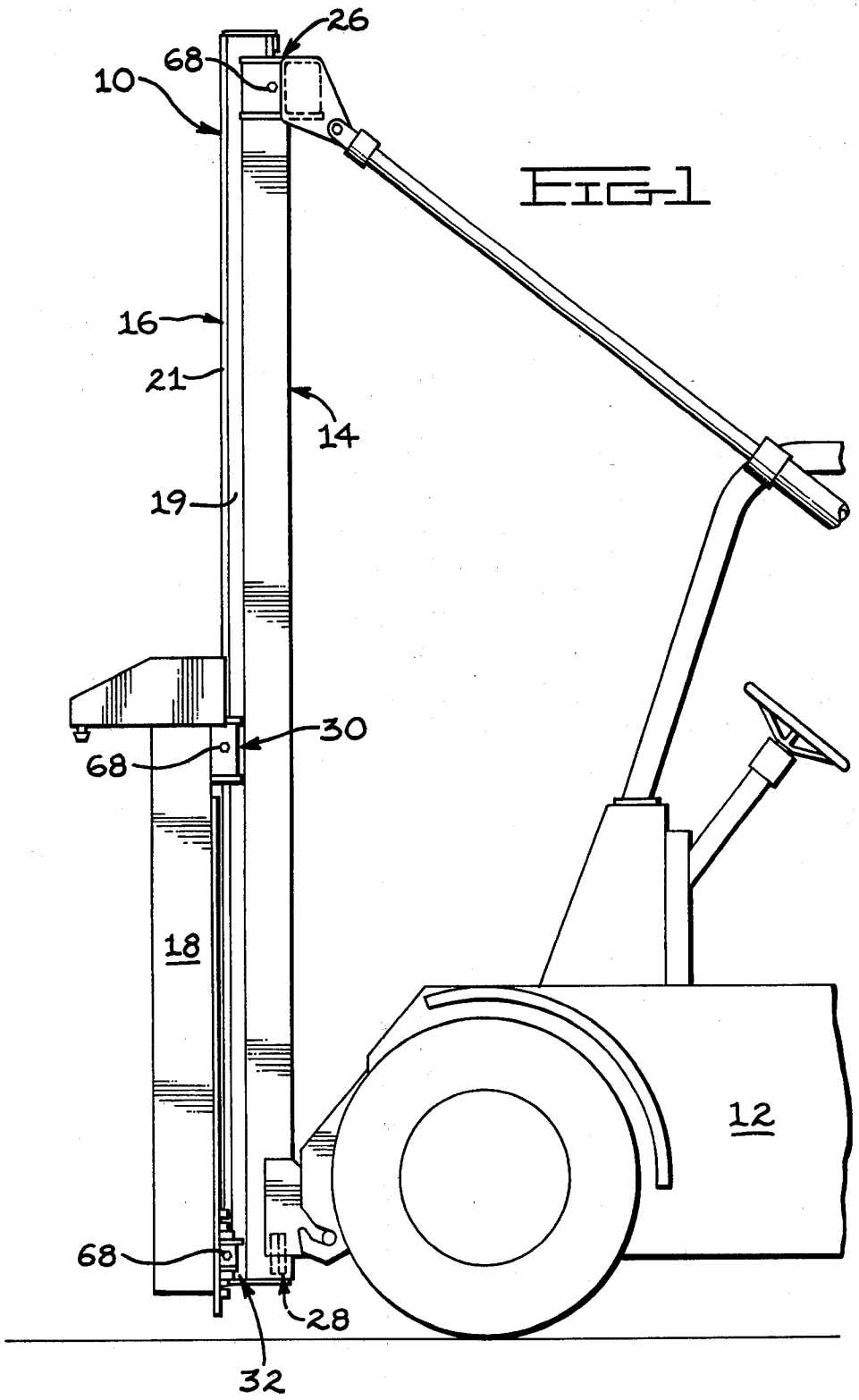
FIG. 1 is a diagrammatic side view of the front portion of a lift truck having a lift mast incorporating one form of the present invention.
Figure 2:
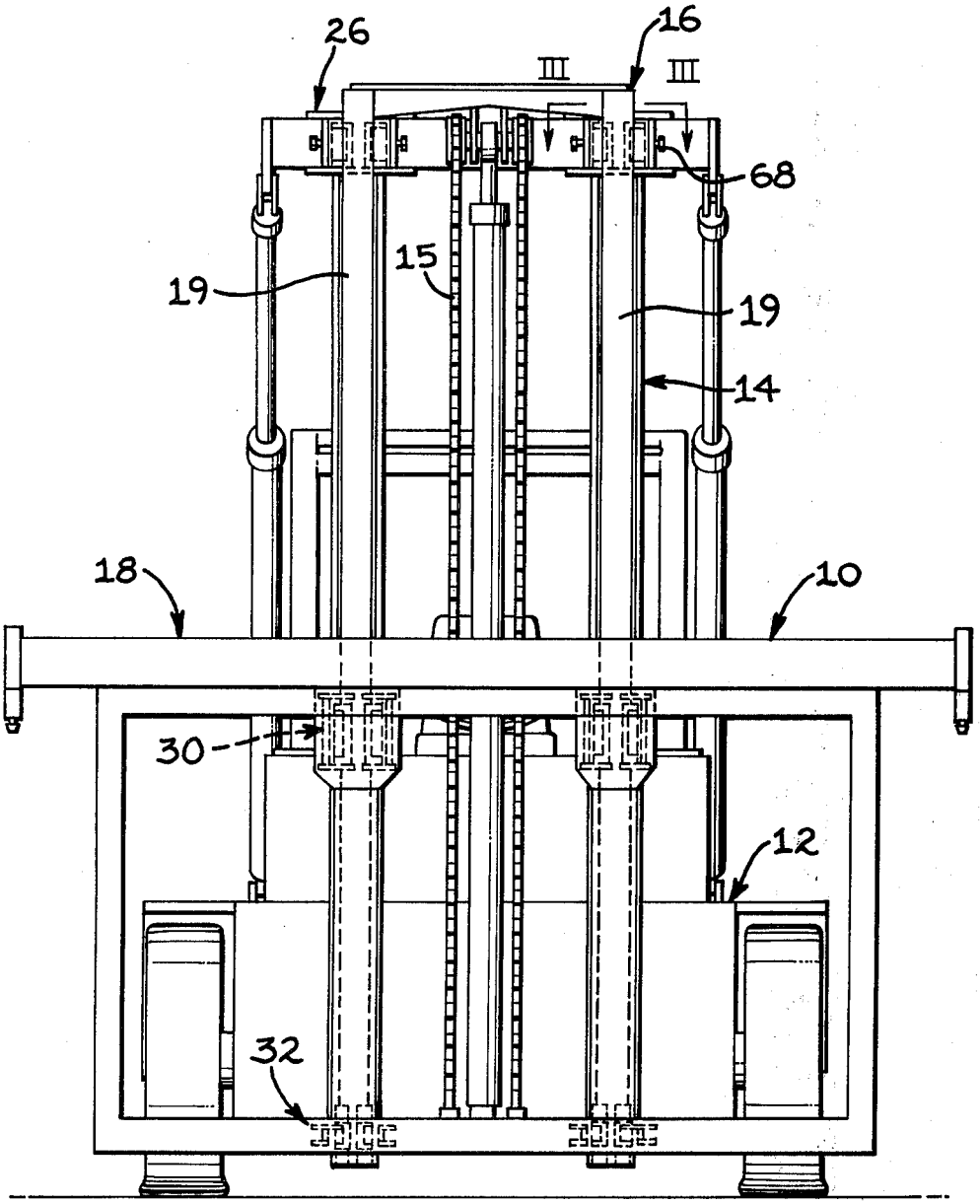
FIG. 2 is a diagrammatic front view of the lift truck of FIG. 1.

Referring to FIGS. 1 and 2 a lift mast embodying one form of the present invention is generally indicated by the reference numeral 10. The embodiment and use of the present invention, an adjustable slider bearing assembly for a lift mast, described in detail below, is presently believed to be the best mode of the best application of this invention. Those skilled in the art will recognize many other advantageous applications of the present invention.

The lift mast 10 is mounted on a work vehicle 12 and includes a support frame 14 pivotally attached to the work vehicle 12 in a manner permitting controlled fore and aft tilting, an upright assembly 16 connected to the support frame 14 and longitudinally extensible with respect thereto, and a carriage 18 connected to the upright assembly 16 and longitudinally movable with respect thereto. A pair of lift chains 15 are connected by one end to the support frame 14, are trained over the upright assembly 16 and are connected by the other end to the carriage 18.

Henceforth, all spatial directions will be related to the work vehicle 12 as follows: the "longitudinal axis" is parallel to the direction of translational motion of the work vehicle 12 and lies in the vertical plane of symetry of the work vehicle 12; "inboard" is nearer the longitudinal axis than "outboard;" "fore" is nearer that end of the work vehicle 12 to which the lift mast 10 is connected than "aft;" and "up" and "down" have their customary meanings.

Figure 3:
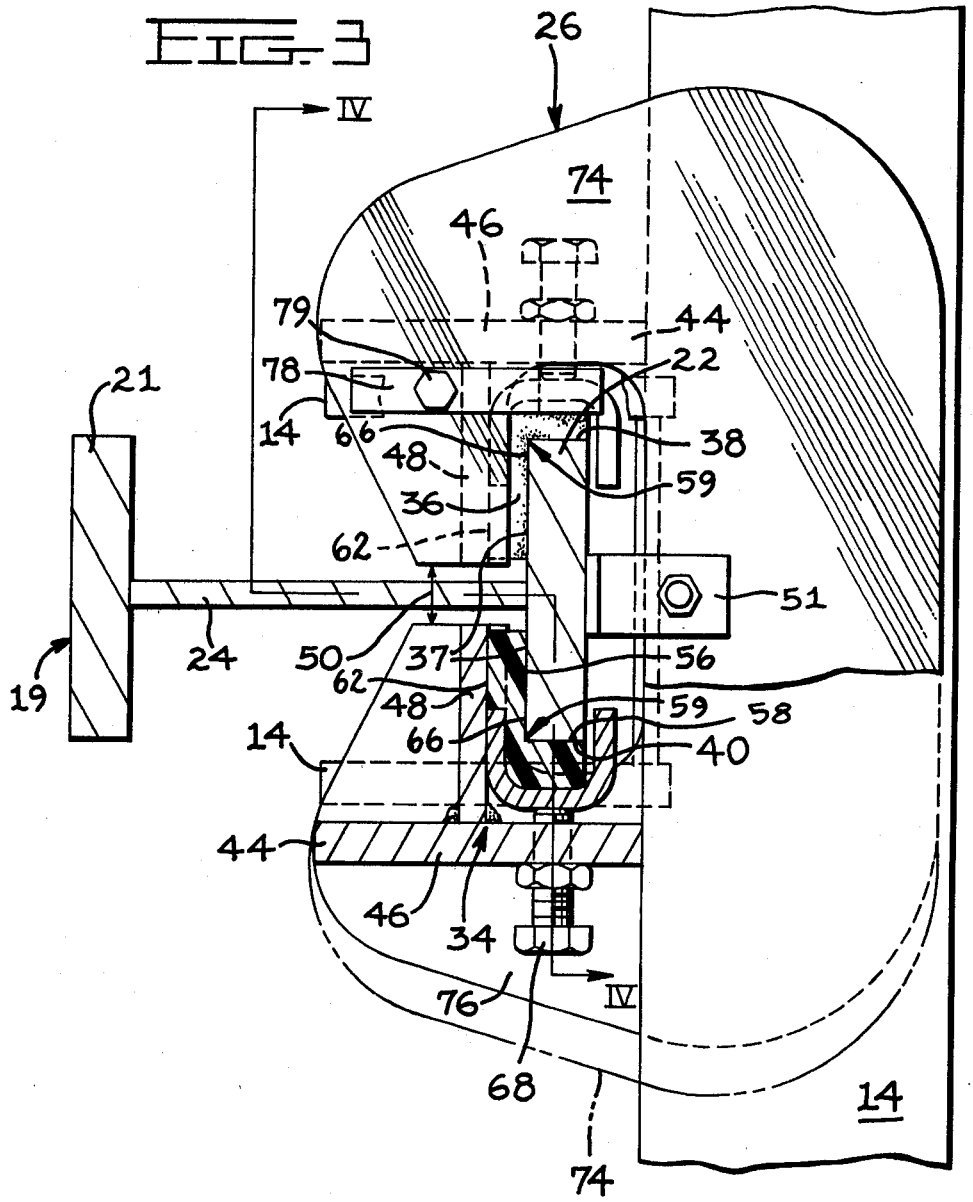
FIG. 3 is a diagrammatic partially broken away sectional view taken along line III—III of FIG. 2 showing details of the upper support frame-upright support assembly.

The upright assembly 16 includes two parallel vertical beams 19, preferably I-beams, rigidly joined one to the other. As best shown in FIG. 3, each I-beam 19 has two flanges, a fore flange 21 and an aft flange 22, joined by a fore and aft extending web 24.

Two pairs of connecting assemblies join the carriage 18 to the vehicle upright assembly 16, and two other pairs join the vertical support assembly 16 to the support frame 14.

More specifically, and as shown in FIG. 1, the aft flange 22 of each I-beam 19 is guided and retained by an upper upright-support frame support assembly 26 and a lower upright-support frame support assembly 28. The fore flange 21 of each I-beam 19 has associated with it an upper upright-carriage support assembly 30 and a lower upright-carriage support assembly 32. These connecting assemblies 26,28,30,32 serve to support the carriage 18 upon the upright assembly 16 and the upright assembly 16 upon the support frame 14. The support assemblies 26,28,30,32 each permit relative movement in the direction of the length of the I-beams 19 between the two members associated by each support assembly 26,28,30,32. That is, the carriage 18 moves substantially vertically along a track defined by the fore flanges 21 of the I-beams 19 and the I-beams 19 themselves move substantially vertically along a track defined by the upper and lower upright-support frame support assemblies 26,28.

In the remainder of this description of the best embodiment of the present invention two types of connecting assemblies will be detailed. The first, the upper upright-support frame support assembly 26, is suited for applications in which the two members to be joined have imposed upon them a loading tending to force them apart. The second, the lower upright-carriage support assembly 32, is suited for applications in which the two members to be joined thereby have imposed upon them a loading tending to force them together. Variations of the detailed aspects of the present invention will render other useful embodiments apparent to those skilled in the art.

As shown in FIGS. 3–6 the support assemblies 26,32 each include a loading portion 34 for accepting fore-aft and side loadings, and a pair of identical slider bearings 36 interposed between the loading portion 34 and the I-beam 19. Each of the support assemblies 26,32 symetrically loads the I-beam 19 with which it is associated by imposing loads on the relevant flange 21,22 which are substantially equal about either side of the web 24. That is, forces tending to place the web 24 in compression or tension are imposed upon the relevant flange 21,22 substantially equally on each half of the flange 21,22 (the halves being divided by the web 24). This loading is imposed at main loading surfaces 37 on the flange 21,22, these loading surfaces 37 being substantially perpendicular to the web 24. Side loadings are imposed on inboard and outboard edges 38,40 of each flange 21,22 by the slider bearings 36. Alternatively, these side loadings could be imposed on both sides of the web 24 itself rather than on the flange 21,22. Means such as a positionable fulcrum 68, to be detailed subsequently, is provided for maintaining the slider bearings 36 in full face contact with said inboard and outboard flange edges 38,40.

Figure 4:
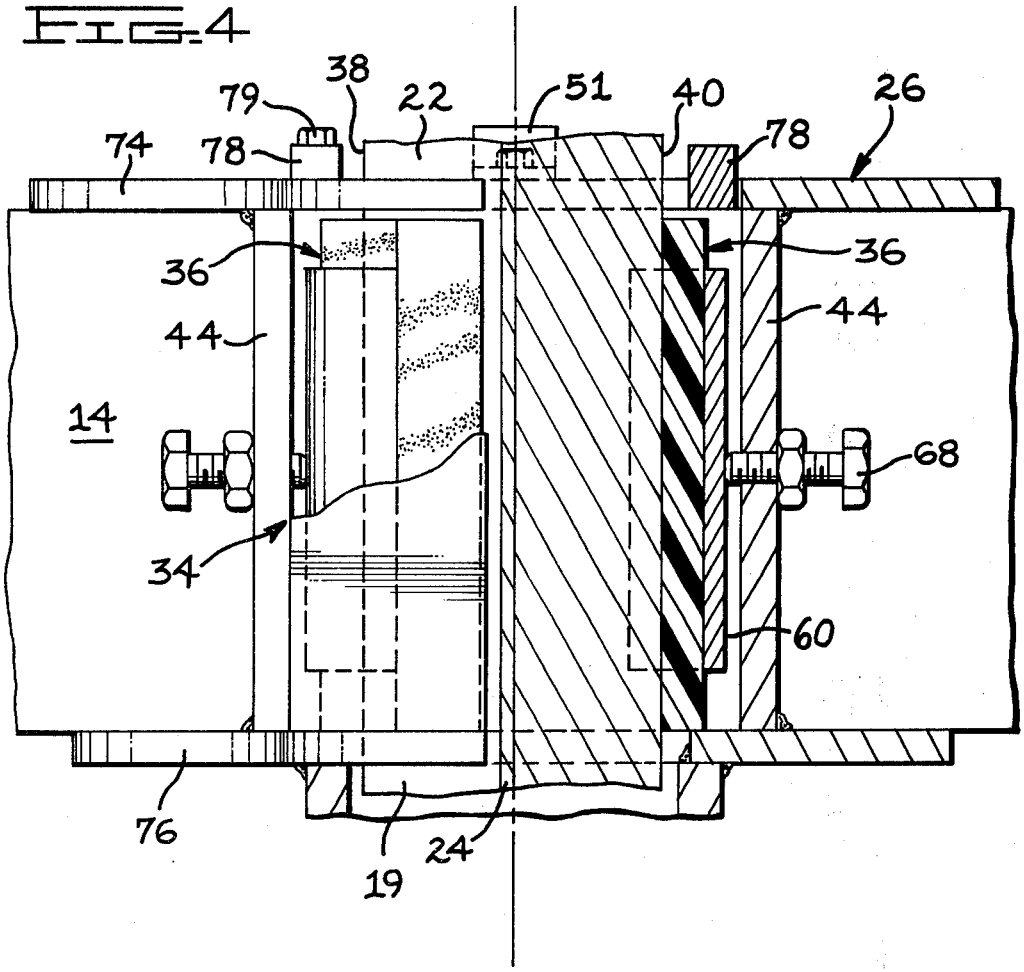
FIG. 4 is a diagrammatic partially broken away sectional view taken along line IV—IV of FIG. 3 showing further details of the upper support frame-upright support assembly.

Detailed in FIGS. 3 and 4 is a preferred embodiment of a of upper upright-support frame support assembly 26. Forewardly projecting from the support frame 14 and rigidly connected thereto is a pair of parallel first support members 44. These are each positioned to receive the corresponding one of the two I-beams 19. The pair of support members 44 are spaced a greater distance apart, preferably 2–8 cm greater, than the width of the aft flange 22. Rigidly connected to a center portion 46 of each first support member 44 is a first loading member 48 symetrically disposed with respect to and extending toward the other of said first loading members 48. These first loading members 48 do not extend sufficiently far as to meet, but are separated by a distance preferably 2–3 times greater than the thickness of the web 24. This separation defines a first gap 50 through which the web 24 extends. The first support members 44 and the first loading members 48 define the loading portion 34 of the upper upright-support frame support assembly 26. A stop 51 projecting from the support frame 14 at a position immediately aft of the aft flange 22 limits movement of the I-beam 19 toward the support frame 14.

Interposed between this loading portion 34 and the aft flange 22 are the slider bearings 36. A preferred form of the slider bearings 36 is detailed in FIGS. 7 and 8. Each slider bearing assembly 36 has a bearing portion 52 of generally L-shaped configuration defining an inner right angle. The two bearing surfaces forming this inner right angle are a main loading slider bearing face 56 for supporting the fore and aft loadings imposed upon the support assemblies 26,28,30,32 and an edge loading slider bearing face 58 for supporting side thrust loadings. These faces 56,58 together define a bearing surface 59 which is that portion of the bearing 36 which comes in physical contact with the flange of the I-beam 19.

The bearing portion 52 of the slider bearings 36 is preferably composed of an ultra high molecular weight polymer such as ultra high molecular weight high density polyethylene. Other suitable organic plastics as would be familiar to one skilled in the art would also be acceptable.

Figure 7:
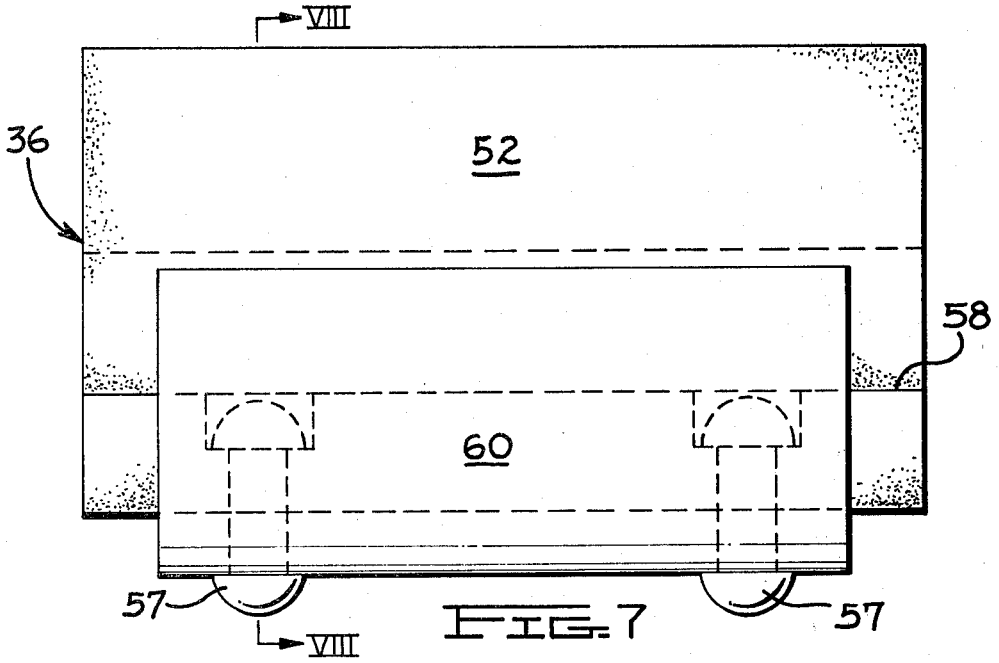
FIG. 7 is a diagrammatic side elevational view of a slider bearing suitable for use in the present invention.
Figure 8:
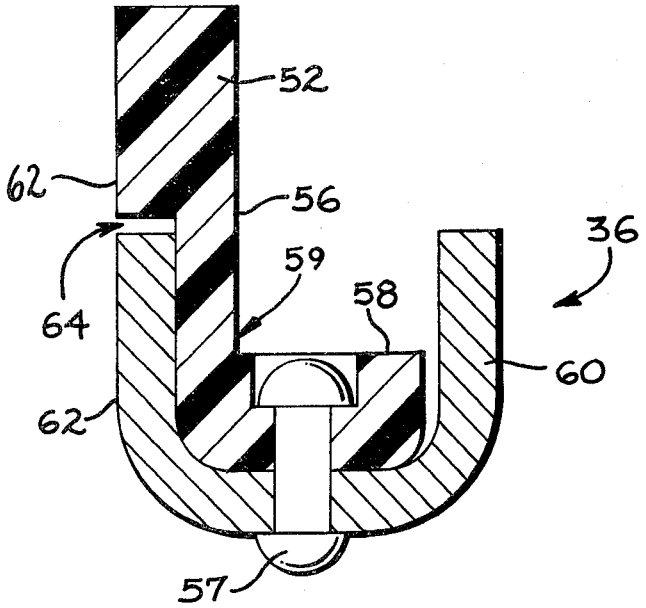
FIG. 8 is a diagrammatic sectional view taken along line XII—XII of FIG. 7 with the fastener shown in elevation.

As shown in FIGS. 7 and 8 a backing 60 of generally U-shaped configuration is attached to the bearing portion 52 to provide a stiff support. This backing 60 is preferably fashioned of steel and is connected to the bearing portion 52 by rivets 57 recessed so as not to extend above the edge loading face 58. This connection could also be accomplished with a single sheet metal screw. The backing 60 and the bearing portion 52 define a flush loading surface 62 parallel to the main loading slider bearing face 56. A gap or discontinuity 64 in the flush loading surface 62 between the bearing portion 52 and the backing 60 is permitted.

As shown in FIGS. 3 and 4 these slider bearings 36 are positioned, one inboard and the other outboard, so that the flush loading face 62 of each contacts the first loading member 48 and the main loading slider bearing face 56 of each contacts a web proximal face 66 of said aft flange 22. A positionable fulcrum 68 such as a positioning screw is disposed through each of the first support members 44. This fulcrum 68 abuts the support portion 60 of the slider bearings 36 and serves to position the edge loading slider bearing face 58 of each slider bearing 36 against the respective inboard or outboard flange edge 38,40. It is important that the abutment between the positioning screw 68 and the slider bearing 36 be such that the slider bearing 36 can pivot about the positioning screw 68 so as to remain in full-face surface contact with the flange edges 38,40.

The upper upright-support frame support assembly 26 has first upper and lower bearing restraining members 74 and 76 which restrain the slider bearings 36 from, respectively, substantial upward and downward movement. Additionally, the first upper bearing restraining member 74 is provided with restraining elements 78 removably and rigidly attached thereto by bolts 79 or the like. These restraining elements 78 overlie and provide access to the slider bearing 36 of the upper upright-support frame support assembly 26.

Detailed in FIGS. 5 and 6 is a preferred embodiment of a lower upright-carriage support assembly 30 embodying the principles of the present invention. Each support assembly 30 has a pair of parallel second support members 80 projecting aftwardly from the carriage 18 and rigidly attached thereto. Preferably these are spaced apart 2–8 cm greater than the width of the fore flange 21. These second support members 80 flank a flat loading surface 81. A pair of slider bearings 36 identical in construction to those described previously are interposed between the flat loading surface 81 and a foremost surface 82 on the fore flange 21 such that the main loading slider bearing face 56 is in contact with the fore flange 21. Positioning screws 68 are adjustably positioned in each of the second support members 80 such that they abut the slider bearings 36 and force the edge loading slider bearing face 58 against the respective inboard or outboard flange edge 38,40. A pair of second upper and a pair of second lower bearing retaining members 84,86, shown in FIG. 5, restrain the slider bearings 36 from vertical displacement. These are removable to facilitate replacement of the slider bearings 36.

The positioning screws 68 for each support assembly 26,30,32 are preferably arranged on the lift mast 10 so as to be readily accessible for ease of adjustment. The positioning screws 68 have slider bearing abutment ends which may be flat or rounded for abutting a flat portion of each slider bearing 36. Alternatively the slider bearings 36 may be provided with a rounded recess (not shown) into which a rounded slider bearing abutment end 88 may fit.

The present invention could alternatively be utilized in a lift mast 10 having an upright assembly 16 including beams 19 having a web 24 with a single flange. Such a lift mast 10 might have only a single vertically movable element. Such masts are known to those skilled in the art. Similarly, the present invention could be utilized in a lift mast 10 having a plurality of nested movable upright assemblies.

Industrial Applicability

The present invention provides an advantageous bearing assembly for use in lift masts and for other applications in which a first member such as a carriage 18 or a vertical upright assembly 16 is guided by and translatable with respect to a second member such as, respectively, a verticle upright assembly 16 or a support frame 14.

In the utilization of the present invention, a carriage 18 bears a load (not shown) forward from the upright assembly 16 supporting the carriage 18. The carriage 18 and its load impose a downward loading on the upright assembly 16 which is countered by an oppposite and upward force imposed by the lift chains 15 attached to the carriage 18 at a position near the upright assembly 16 as is shown in FIG. 1. The downward force of the loaded carriage 18 is forward of the position at which the countering upward force of the load supporting lift chains 15 acts. Consequently these otherwise balanced forces, the weight of the load and the weight supporting lift chains, do not act in a colinear fashion. This results in a moment arm between these opposing forces, this creating a torque tending to rotate the carriage 18 forward.

This torque is countered by the upper and lower upright-carriage support assemblies 30,32. It is important to realize that these connection assemblies, when oriented as previously detailed, can support loadings lying in the horizontal plane only. The upper and lower upright-carriage support assemblies 30,32 impose equal but opposite loadings to create a torque equal and opposite the torque imposed by the loaded carriage 18. This second torque itself imposes a forward tilting force on the upright assembly 16 which is countered by the upper and lower upright-support frame support assemblies 26,28. The torque countering loadings imposed upon these support assemblies 26,28,30,32 are applied to the flanges 21,22 of each I-beam 19 in the upright assembly 16.

An advantageous feature of the present invention is its use of slider bearings 36, which impose a load on the relevant flange 21,22 on both sides of the web 24. The I-beam 19 is thereby substantially symetrically loaded (that is, equally on each side of the web 24) thereby preventing the imposition of any significant torque about a vertical axis. If only one side of the flange was loaded a torque would be created which would tend to twist the two flanges 21,22 out of parallel alignment. Furthermore, the use of slider bearings 36 rather than roller bearings provides a relatively large area of contact advantageously distributing the load along a portion of the I-beams 19.

In the operation of a lift mast 10 it is very common to have a load (not shown) unevenly transversely distributed producing a sideward tilting moment in the entire carriage 18. Each slider bearing 36 in the support assemblies 26,28,30,32 of the present invention contacts a flange edge 30,40 such that any side tilting of the carriage 18 causes one of the slider bearings 36 of each support assembly to contact an edge 38,40 of the flange 20,22 it engages. This is deemed "side-thrust loading" in the art. For example, should the carriage 18 be most heavily loaded on its left side it will tend to tilt toward the left; this will be countered by the right slider bearings 36 of the upper upright-carriage support assemblies 30 contacting the corresponding right flange edge 38,40. Likewise, the left slider bearing 36 of each of the lower upright-carriage support assemblies 32 will contact a left flange edge 38,40. Contact at these four points will resist excessive tilting.

It is a further advantage of the present invention that each slider bearing 36 contacts both a flange edge 38,40 and a main loading surface 37 on the corresponding flange 21,22. Each individual slider bearing 36 then is used to accept two distinct loads which are mutually perpendicular. This dual use of a single slider bearing 36 yields increased simplicity of manufacture and maintenance.

Each support assembly 26,30,32 has a pair of positioning screws 68 for inboard-outboard positioning of the associated slider bearing 36. This provides for transverse adjustability of the separation of the two edge loading slider bearing faces 58 of the support assemblies 26,30,32. As the slider bearings 36 become worn these positioning screws 68 may be adjusted inward a predetermined amount so as to eliminate undue "slop". The use of shims is thereby avoided. These positioning screws 68 are easily adjustable and may be arranged so as to be readily accessible.

The positioning screws 68 provide a second advantage in that they provide a fulcrum about which the slider bearing 36 may pivot. This ensures that the edge loading slider bearing face 58 remains in full face contact with the corresponding flange edge 38,40 even should the first support member not be parallel to the flange edge 38,40.

Other aspects, objects and advantages of the present invention can be obtained from a study of the drawings, the disclosure and the appended claims.

I claim:

1. A lift mast (10) for a lift truck (12) comprising:

a support frame (14) attached to said lift truck (12);

an upper upright-support frame support assembly (26) attached to said support frame (14);

a lower upright-support frame support assembly (28) attached to said support frame (14);

an upright assembly (16) retained by said upper and lower upright-support frame support assemblies (26,28), said upright assembly (16) having at least one I-beam (19), said I-beam having flanges (21,22) and a web (24), said web (24) having opposite sides and said upright assembly (16) being longitudinally movable through said support assemblies (26,28);

a carriage (18);

an upper upright-carriage support assembly (30) attached to said carriage (18) and connecting said carriage (18) to said upright assembly (16);

a lower upright-carriage support assembly (32) attached to said carriage (18) and connecting said carriage (18) to said upright assembly (16);

at least one of said support assemblies (26,28,30,32) having two slider bearings (36), one of said two slider bearings contacting one of said flanges (21,22) on one side of said web (24) and the other of said two slider bearings (36) contacting said one flange (21,22) on the other side of said web (24), said slider bearings (36) each being supported by a fulcrum (68).

2. A supporting assembly for movably and guidably connecting a first member (16) of a lift mast to a second member (14) of said lift mast for relative translation therebetween, comprising:

a first and a second fulcrum (68) unyieldably connected to said second member (14);

upper and lower bearing restraining means (74,76,84,86) connected to said second member (14) at elevationally spaced apart locations thereon;

a first bearing (36) having a bearing surface (59) and a backing member (60), said first bearing backing member (60) being in contactable abutting engagement with said first fulcrum (68), said first bearing being universally pivotal relative to said first fulcrum (68) and movable in response to movement of the first member (16) to self-align and maintain full surface contact between the bearing surface (59) of said first bearing (36) and said first member (16);

a second bearing (36) having a bearing surface (59) and a backing member (60), said second bearing backing member (60) being in contactable abutting engagement with said second fulcrum (68), said second bearing being universally pivotal relative to said second fulcrum (68) and movable in response to movement of the first member (16) to self-align and maintain full surface contact between the bearing surface (59) of said second bearing (36) and said first member (16);

said first and second bearings (36) being loosely positioned between said upper and lower restraining means (74,76,84,86) and contactably engaged with said upper and lower restraining means (74,76,84,86) to maintain said first and second bearings (36) from movement past said upper and lower restraining means;

said first member (16) having an elongated web (24) and an elongated flange (22), said elongated flange having an inboard edge (38), an outboard edge (40) and a main loading surface (37), said main loading surface (37) being connected to said web (24) and substantially perpendicular to said web (24), said inboard and outboard edges (38,40) being positioned on opposite sides of said web (24); and said bearing surface (59) of the first bearing (36) being contactably slidably engaged with the outboard edge (40) and said main loading surface (37), and the bearing surface (59) of the second bearing (36) being contactably slidably engaged with the inboard edge (40) and said main loading surface (37).

3. The supporting assembly as set forth in claim 2 wherein said first fulcrum (68) is extensibly adjustably movable relative to said second member (14), said first bearing (36) being movable in response to selective extensible adjustable movement of said first fulcrum (68) between a first position at which said bearing surface (59) is spaced from contact with said first member (16) and a second position at which said bearing surface (59) is in aligned full surface contact with said first member (16).

4. The supporting assembly as set forth in claim 2 wherein said first and second fulcrum (68) face one another and are individually selectively extensibly movably adjustable relative to said second member (14) and one another, said first bearing (36) being movable relative to and in directions toward and away said first member (16) in response to movement of said first fulcrum (68) and said second bearing (36) being movable relative to and in directions toward and away said first member (16) in response to movement of said second fulcrum (68).

5. The supporting assembly as set forth in claim 1 wherein said first and second bearings (36) each have a flush loading surface (62) and said second member (14) has a pair of first loading members (48) connected thereto, each loading member of said pair of first loading members (48) being parallel to the main loading surface (37) of the elongated flange (22) and contactably engageable with a respectively adjacent one of said flush loading surfaces (62).

6. The supporting assembly as set forth in claim 2 wherein the bearing surface (59) of the first and second bearings (36) includes:

a main loading slider bearing surface (56) and an edge loading slider bearing surface (58), said main loading slider bearing surface (56) being contactably engageable with said main loading flange surface (37) and said edge loading slider bearing surface (58) of respective ones of said first and second bearings being contactably engageable with an adjacent respective ones of said inboard and outboard edges (38,40), said edge loading slider bearing surface (58) being substantially perpendicular to said main loading slider bearing surface (56).

7. A supporting assembly for movably and guidably connecting a first member (16) of a lift mast to a second member (14) of said lift mast for relative translation therebetween, comprising:

a first and a second fulcrum (68) ynyieldably connected to said second member (14);

upper and lower bearing restraining means (74,76,84,86) connected to said second member (14) at elevationally spaced apart locations thereon;

a first bearing (36) having a bearing surface (59) and a backing member (60), said first bearing backing member (60) being in contactable abutting engagement with said first fulcrum (68), said first bearing being universally pivotal relative to said first fulcrum (68) and movable in response to movement of the first member (16) to self-align and maintain full surface contact between the bearing surface (59) of said first bearing (36) and said first member (16);

a second bearing (36) having a bearing surface (59) and a backing member (60), said second bearing backing member (60) being in contactable abutting engagement with said second fulcrum (68), said second bearing being universally pivotal relative to said second fulcrum (68) and movable in response to movement of the first member (16) to self-align and maintain full surface contact between the bearing surface (59) of said second bearing (36) and said first member (16);

said first and second bearings (36) being loosely positioned between said upper and lower restraining means (74,76,84,86) and contactably engaged with said upper and lower restraining means (74,76,84,86) to maintain said first and second bearings (36) from movement past said upper and lower restraining means;

said first and second bearings (36) having a bearing portion (52), said bearing portion having an L-shaped configuration and being composed of an ultra high molecular weight polymer, said backing (60) member being connected to the bearing portion (52) and said bearing portion (52) being engaged with said first member (16).

8. The supporting assembly as set forth in claim 7 wherein said first and second fulcrums (68) are threaded members screwthreadably connected to said second member (14).

9. The new supporting assembly as set forth in claim 7 wherein said first member (16) is an elongate upright beam of said lift mast (10) and the second member (14) is one of a support frame (14) and carriage (18) of said lift mast (10).

* * * * *

UNITED STATES PATENT AND TRADEMARK OFFICE

CERTIFICATE OF CORRECTION

PATENT NO. : 4,442,922

DATED : April 17, 1984

INVENTOR(S) : Richard J. Johannson

It is certified that error appears in the above-identified patent and that said Letters Patent are hereby corrected as shown below:

Column 9, line 9: delete "1" and insert --2--.
line 36: delete "ynyieldably and insert --unyieldably--.

Column 10, line 37: delete "new".

Signed and Sealed this

*Twenty-eighth* Day of *August 1984*

[SEAL]

*Attest:*

GERALD J. MOSSINGHOFF

*Attesting Officer*

*Commissioner of Patents and Trademarks*